US008394038B2

(12) United States Patent
Ashihara et al.

(10) Patent No.: US 8,394,038 B2
(45) Date of Patent: Mar. 12, 2013

(54) WALKING ASSISTANCE DEVICE

(75) Inventors: Jun Ashihara, Wako (JP); Hiroshi Kudoh, Wako (JP); Hiroshi Matsuda, Wako (JP); Takeshi Koshiishi, Wako (JP); Yutaka Hiki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 701 days.

(21) Appl. No.: 12/612,863

(22) Filed: Nov. 5, 2009

(65) Prior Publication Data

US 2010/0121233 A1 May 13, 2010

(30) Foreign Application Priority Data

Nov. 6, 2008 (JP) ..... 2008-285476
Oct. 27, 2009 (JP) ..... 2009-246857

(51) Int. Cl.
*A61H 1/00* (2006.01)

(52) U.S. Cl. ..... 601/5; 601/33; 601/34; 601/35

(58) Field of Classification Search ..... 600/595; 601/5, 27–35; 602/5, 16, 23, 24, 28, 25–27, 602/29–30; 623/24, 27, 32, 39, 40, 47, 53, 623/48

See application file for complete search history.

(56) References Cited

U.S. PATENT DOCUMENTS 3,230,952 A * 1/1966 Candido ..... 602/16
5,282,460 A * 2/1994 Boldt ..... 601/5
5,486,157 A * 1/1996 DiBenedetto ..... 602/27
5,728,175 A * 3/1998 Rincoe ..... 623/52
6,036,665 A * 3/2000 Towsley ..... 602/23
6,589,195 B1 * 7/2003 Schwenn et al. ..... 602/23
6,666,796 B1 * 12/2003 MacCready, Jr. ..... 482/51
7,112,181 B1 * 9/2006 DeToro et al. ..... 602/27
7,628,766 B1 * 12/2009 Kazerooni et al. ..... 602/16
2003/0040810 A1 * 2/2003 Molino et al. ..... 623/52
2004/0225375 A1 * 11/2004 Chen ..... 623/38
2006/0270951 A1 * 11/2006 Ikeuchi ..... 601/5
2007/0056592 A1 * 3/2007 Angold et al. ..... 128/845
2008/0156363 A1 * 7/2008 Ikeuchi et al. ..... 135/65
2012/0172770 A1 * 7/2012 Almesfer et al. ..... 601/35

FOREIGN PATENT DOCUMENTS

JP 2007-054616 3/2007

* cited by examiner

*Primary Examiner* — Justine Yu
*Assistant Examiner* — Christopher Miller
(74) *Attorney, Agent, or Firm* — Rankin, Hill & Clark LLP

(57) ABSTRACT

A walking assistance device having an ankle joint limited in a swingable range in a rolling direction, enabling a user to open his/her legs apart more easily. The walking assistance device includes a seating member 1, a pair of leg links 2 and 2 which support the seating member 1 from below, and a ground contact member 8 connected to each leg link 2 through an ankle joint 7. The ankle joint 7 has a coupling mechanism 100 which includes a joint shaft member 106 and a retaining portion which swingably retains the joint shaft member 106 in the rolling direction in a predetermined range ϕ. The joint shaft member 106 is inclined to an abduction side in the rolling direction from the middle position of the predetermined range ϕ in which the joint shaft member is swingable in the rolling direction when the walking assistance device is in an upright state.

9 Claims, 4 Drawing Sheets

WALKING ASSISTANCE DEVICE

BACKGROUND OF THE INVENTION

1. Field of the Invention

The present invention relates to a walking assistance device which assists a user in walking.

2. Description of the Related Art

Hitherto, as this type of walking assistance device, there has been known a walking assistance device which includes a seating member on which a user sits in a straddling manner and a pair of leg links supporting the seating member from below, wherein the leg links receive at least a part of the weight of the user through the seating member to reduce load acting on a leg or legs of the user, thereby assisting the user in walking (refer to, for example, Japanese Patent Application Laid-Open No. 2007-054616).

Further, there has been known another walking assistance device in which a ground contact member to be attached to each of the feet of the user is connected to each leg link through an ankle joint, which is formed of a spherical joint as a coupling mechanism limited in a swinging range in a rolling direction (refer to, for example, paragraph [0048] and FIG. 3 in Japanese Patent Application Laid-Open No. 2007-54616).

If a coupling mechanism, which is limited in a swinging range, like a spherical joint is used for an ankle joint, the limitation in the swinging range may cause a difficulty in making a motion of opening his/her legs apart with the Leg links extended laterally.

SUMMARY OF THE INVENTION

An object of the present invention is to make it easier for a user to open his/her legs apart in a walking assistance device which includes an ankle joint limited in a swinging range in a rolling direction.

The present invention provides a walking assistance device comprising: a seating member on which a user sits in a straddling manner; a pair of leg links supporting the seating member from below; and a ground contact member connected to each of the leg links through an ankle joint, wherein the ankle joint is so configured that the ground contact member is swingable to an abduction side and an adduction side in a predetermined range in a rolling direction with respect to the leg link and a swingable range to the adduction side is greater than that to the abduction side.

The swingable range of a human ankle joint to the abduction side in the rolling direction is relatively narrower than the swingable range to the adduction side in the rolling direction. According to the present invention, since the ankle joint is configured to have a greater swingable range to the abduction side in the rolling direction, the user can easily open his/her legs apart.

In the present invention, the ankle joint has a coupling mechanism which includes a joint shaft member connected at one end to the leg link or to the ground contact member and a retaining portion which swingably retains the other end of the joint shaft member in the rolling direction in the predetermined range and which is provided in the ground contact member or in the leg link; and the joint shaft member is inclined to the abduction side in the rolling direction from the middle position of the predetermined range in which the joint shaft member is swingable in the rolling direction when the walking assistance device is in an upright state.

According to the present invention, the joint shaft member of the ankle joint is inclined to the abduction side in the rolling direction from the middle position of the predetermined range when the walking assistance device is in the upright state, so that the swingable range of the ankle joint to the adduction side in the rolling direction is wider than the swingable range of the ankle joint to the abduction side in the rolling direction when the walking assistance device is in the upright state. This enables the user to open his/her legs apart more easily. Further, the swingable range of a human ankle to the abduction side in the rolling direction is relatively narrow in comparison with the swingable range to the adduction side in the rolling direction, which makes it possible for the ankle joint to follow the ankle motions of the user properly.

The coupling mechanism of the present invention may be, for example, a spherical joint having the retaining portion which swingably retains a sphere provided at the other end of the joint shaft member in the rolling direction in the predetermined range.

In the present invention, the retaining portion may be provided in the leg link rotatably in a yaw direction, the joint shaft member may extend from the retaining portion in a lateral direction, and one end of the joint shaft member may be connected to the ground contact member.

According to the mentioned configuration, when the user turns his/her foot in the yaw direction, the retaining portion rotates, together with the joint shaft member, in the yaw direction with respect to the leg link. Thereby, even the ground contact member attached to the foot of the user rotates in the yaw direction, there is no variation on the swingable range to the abduction side and the adduction side in the rolling direction of the ankle joint, which makes it possible for the ankle joint to follow the ankle motions of the user more properly.

In the walking assistance device according to the present invention, the term "outward" indicates the right direction for the right leg of the user or the left direction for the left leg of the user, and the term "inward" indicates the left direction for the right leg of the user or the right direction for the left leg of the user.

DESCRIPTION OF THE PREFERRED EMBODIMENTS

Figure 1:
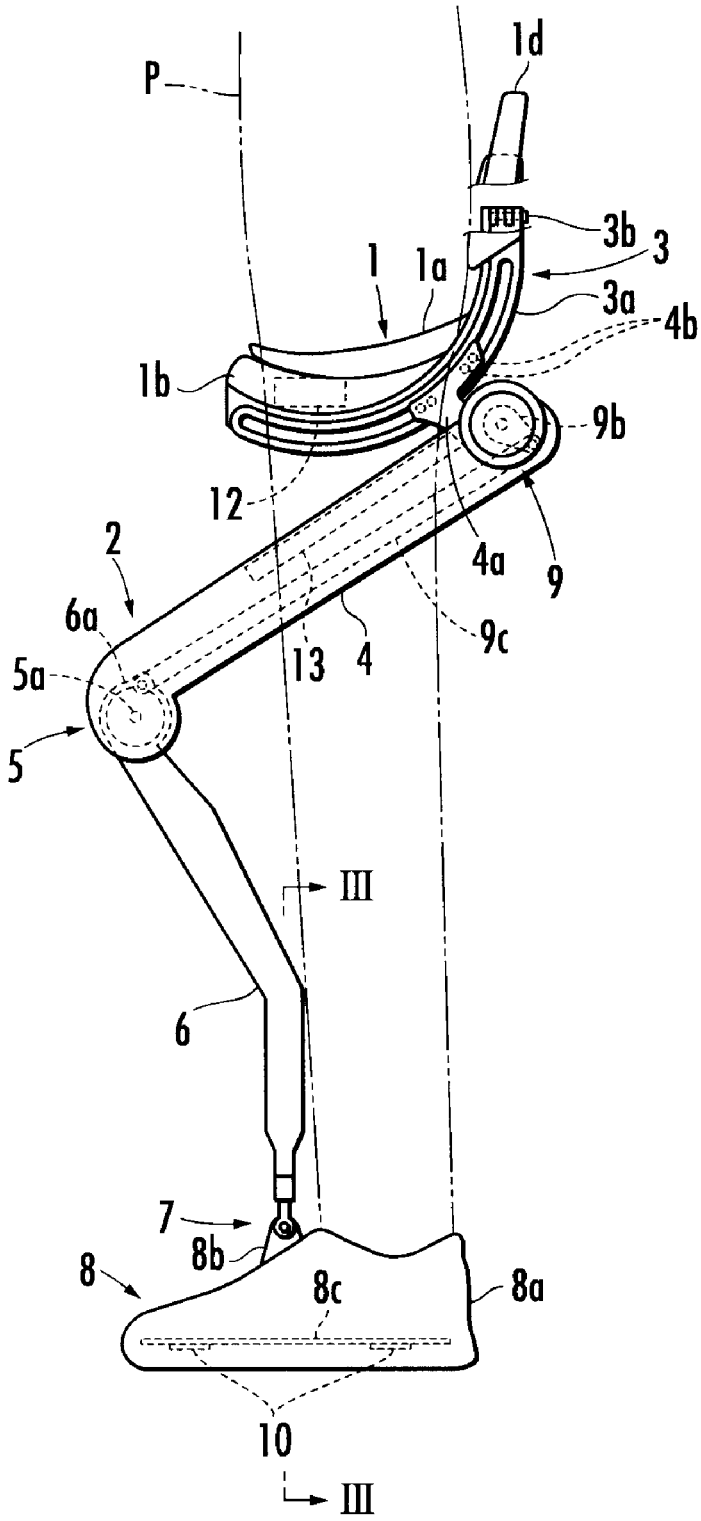
FIG. 1 is a side view illustrating an embodiment of a walking assistance device in accordance with the present invention.
Figure 2:
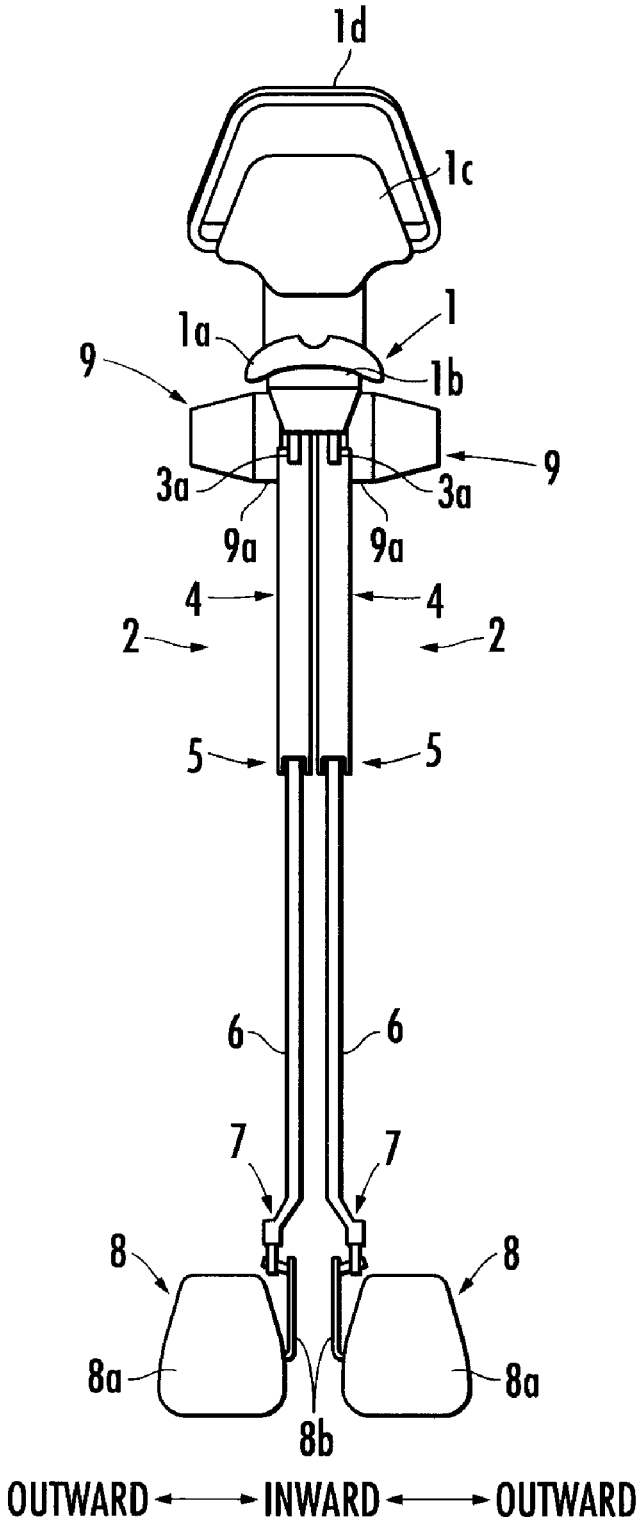
FIG. 2 is a front view illustrating the embodiment of the walking assistance device in accordance with the present invention.
Figure 3:
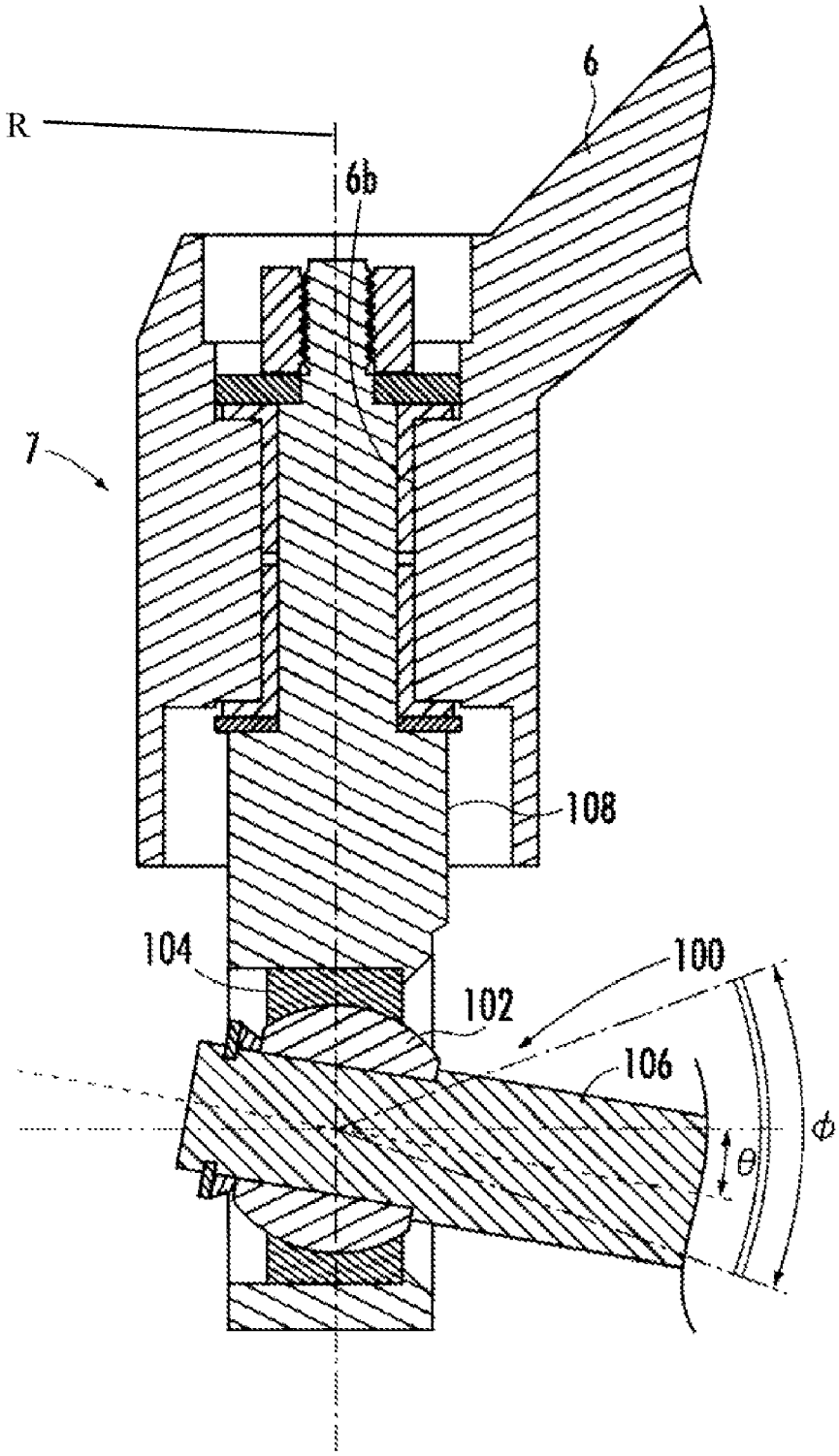
FIG. 3 is a sectional view of the walking assistance device taken at line III-III in FIG. 1.

The following will describe an embodiment of a walking assistance device of the present invention with reference to FIG. 1 to FIG. 3. As illustrated in FIG. 1 and FIG. 2, the walking assistance device has a seating member 1 on which a user P sits in a straddling manner and a pair of right and left leg links 2 and 2 supporting the seating member 1 from below.

Each of the leg links 2 is formed of a bendable link having a first link member 4, which is connected to a first joint 3 provided on the seating member 1, and a second link member 6, which is connected to a lower end of the first link member 4 through a rotary second joint 5 at the lower end of the first link member 4. Further, a ground contact member 8 to be attached to each of right and left feet of the user is connected to a lower end of the second link member 6 through an ankle joint 7.

Each of the leg links 2 is further provided with a drive source 9 for the second joint 5. The second joint 5 is rotationally driven by the drive source 9 to drive each of the leg links 2 in a stretching direction, that is, in the direction for pushing up the seating member 1, thereby generating a force for pushing up the seating member 1 (hereinafter referred to as "the load support force"). The load support force generated in the leg link 2 is transmitted to the body trunk of the user P through the intermediary of the seating member 1. More specifically, a part of the weight of the user P is supported by the leg links 2 and 2 through the intermediary of the seating member 1 due to the load support force, thus reducing the load acting on the legs of the user P.

The seating member 1 is composed of a saddle-shaped seat 1*a* on which the user P sits, a support frame 1*b* on a lower surface supporting the seat 1*a*, and a hip pad 1*c* attached to a rising portion at the rear end of the support frame 1*b*, which rises at the rear of the seat 1*a*. The hip pad 1*c* is provided with an arcuate handle 1*d* which is able to be grasped by the user P.

Further, the seating member 1 has an arcuate guide rail 3*a* constituting the first joint 3 for the leg links 2. The leg links 2 are movably engaged with the guide rail 3*a* through the intermediary of a plurality of rollers 4*b* rotatably attached to a slider 4*a* fixed on the upper end of the first link member 4. Thus, each of the leg links 2 swings in the longitudinal direction about the curvature center of the guide rail 3*a*. The supporting point of the swing of each of the leg links 2 in the longitudinal direction provides the curvature center of the guide rail 3*a*.

Further, the guide rail 3*a* is rotatably supported by a rising portion of the rear end of the support frame 1*b* of the seating member 1 through the intermediary of a longitudinal support shaft 3*b*. Hence, the guide rail 3*a* is connected to the seating member 1 such that the guide rail 3*a* may swing in the lateral direction (in the direction of abducting or adducting an ankle). This allows each of the leg links 2 to swing in the lateral direction, thereby enabling a leg of the user P to be abducted. The curvature center of the guide rail 3*a* and the axial line of the support shaft 3*b* are positioned above the seat 1*a*. This makes it possible to prevent the seating member 1 from significantly tilting vertically or laterally when the weight of the user P shifts.

The drive source 9 is formed of an electric motor with a speed reducer 9*a* mounted on the outer surface of an upper end portion of the first link member 4 of each of the leg links 2. A drive crank arm 9*b* on an output shaft of the speed reducer 9*a* is connected to a driven crank arm 6*a* secured to the second link member 6 coaxially with a joint shaft 5*a* of the second joint 5 through the intermediary of a connection link 9*c*.

With this arrangement, the motive power output from the drive source 9 through the intermediary of the speed reducer 9*a* is transmitted to the second link member 6 through the intermediary of the connection link 9*c*. Then, the second link member 6 swings about the joint shaft 5*a* relative to the first link member 4, causing the leg link 2 to bend or stretch.

Each of the ground contact members 8 has a shoe 8*a* and a connection member 8*b*, which is secured to the shoe 8*a* and which extends in the vertical direction on the inward side thereof. Further, the second link member 6 of the leg link 2 is connected to the connection member 8*b* through the intermediary of the ankle joint 7 having three degrees of freedom.

The ankle joint 7 has a spherical joint 100, which is a coupling mechanism. The spherical joint 100 includes a joint shaft member 106 connected at one end to the connection member 8*b*, a sphere 102 provided at the other end of the joint shaft member 106, and a retaining portion 108 which swingably retains the sphere 102 in a retaining hole 104 penetrating in the lateral direction.

The retaining portion 108 is inserted at its upper end into a through hole 6*b*, which is provided at the lower end of the second link member 6 and which vertically penetrates, thereby being rotatably supported and being rotatable about a rotation axis R in a yaw direction relative to the second link member 6. Further, the joint shaft member 106 extends laterally inward from the retaining portion 108 and is connected to the connection member 8*b* of the ground contact member 8.

Moreover, as illustrated in FIG. 1, a pair of front and rear pressure sensors 10 and 10 for detecting load acting on a metatarsophalangeal joint (MP joint) portion and a heel portion of a foot of the user P are installed on the bottom surface of an insole 8*c* provided in the shoe 8*a*. In addition, a two-axis force sensor (not shown) is built in the ankle joint 7.

The support frame 1*b* of the seating member 1 incorporates a controller 12, which is a control means, while the first link member 4 incorporates a battery 13.

The detection signals of the pressure sensors 10 and the force sensor (not shown) are input to the controller 12. Then, the controller 12 controls the drive source 9 on the basis of the signals from these pressure sensors 10 to drive the second joint 5, thereby executing the walking assistance control for generating the aforesaid load support force.

Here, the load support force acts on a line which connects the support point of the longitudinal swing of the leg link 2 at the first joint 3 and the support point of the longitudinal swing of the leg link 2 at the ankle joint 7, as observed from a lateral direction (hereinafter referred to as "the reference line").

Therefore, in the walking assistance control, an actual load support force acting on the reference line (to be precise, the resultant force of a load support force and the force from the weights of the seating member 1 and the leg links 2) is calculated on the basis of the detection values of the forces in the directions of two axes detected by the force sensor (not shown). Further, based on the detected pressures of the pressure sensors 10 of each of the ground contact members 8, the ratio of the acting load of each foot in relation to the total load acting on both feet of the user P is calculated.

Subsequently, a value obtained by multiplying a set value of a load support force, which is set beforehand, by the ratio of the load of each foot is calculated as a control target value of the load support force to be generated at each of the leg links 2. Then, the drive source 9 is controlled such that the actual load support force calculated on the basis of the detection values of the force sensor (not shown) agrees with the control target value.

In the ankle joint 7 with the spherical joint 100 having the above configuration, the joint shaft member 106 comes in contact with the retaining portion 108 when the joint shaft member 106 swings in a rolling direction, thus limiting a swingable range in the rolling direction. Therefore, the limitation in the swinging range in the rolling direction may make it impossible for the user to fully open his/her legs apart.

Therefore, in this embodiment, the joint shaft member 106 is inclined in the outward rolling direction by an angle $\theta$ from the middle position of a predetermined range $\phi$ in which the joint shaft member 106 is swingable in the rolling direction when the walking assistance device is in the upright state shown in FIGS. 1 and 2. In other words, the swingable range to the adduction side in the predetermined range $\phi$ is wider than the swingable range to the abduction side.

For example, if the joint shaft member 106 is placed in the middle position of the predetermined range $\phi$ where the predetermined range $\phi$ is 40 deg and the angle $\theta$ is 10 deg, the swingable range is 20 deg in both inward and outward rolling directions. If, however, the joint shaft member 106 is inclined to the abduction side in the rolling direction by the angle $\theta$ (10 deg) from the middle position of the predetermined range $\phi$ as in the embodiment, the swingable range is 30 deg to the adduction side in the rolling direction. Thus, the user is able to fully open his/her legs apart.

Although the swingable range to the abduction side in the rolling direction is as narrow as 10 deg if the ankle joint 7 is configured as described above, the swingable range of a human ankle is narrow to the abduction in the rolling direction, which makes it possible for the ankle joint 7 to follow the ankle motions of the user properly.

Moreover, the joint shaft member 106 is inclined in an outward rising manner as shown in F*ig*. 3, and therefore the retaining portion 108 is located further upward than in the case where the joint shaft member 106 is horizontally disposed. Therefore, when the user wears the shoe 8*a* , the retaining portion 108 does not interfere with the motion, thus making it possible to prevent the user from feeling uncomfortable.

If the joint shaft member 106 is inclined in the longitudinal direction in such a way that the sphere 102 is positioned forward of a connection portion where the joint shaft member 106 is connected to the connection member 8*b* in addition to the above configuration, the user is able to wear the shoe 8*a* more easily.

Although the spherical joint 100 is used as a coupling mechanism in this embodiment, the coupling mechanism is not limited thereto, but the effect of the present invention is achieved by any other components as long as the retaining portion swingably retains the joint shaft member in the rolling direction in a predetermined range.

Moreover, although the retaining portion 108 is connected to the leg link 2 and the joint shaft member 106 is connected to the ground contact member 8 through the intermediary of the connection member 8*b* in the embodiment, alternatively the retaining portion 108 may be connected to the ground contact member 8 and the joint shaft member 106 may be connected to the leg link 2.

As illustrated in FIG. 3 of the embodiment, the retaining portion 108 is disposed in the vertical direction and the joint shaft member 106 is inclined in the outward rising manner. However, the present invention is not limited thereto. It is acceptable to dispose the joint shaft member 106 in the horizontal direction and to incline the retaining portion 108 outward so as to obtain the effect of the present invention, namely, to increase the swingable range to the adduction side in the rolling direction, which makes is possible to follow the ankle motions of the user properly.

In this case, by inclining only the lower end of the retaining portion 108 for retaining the sphere 102 and extending the upper end of the retaining portion 108 rotatably supported by the through hole 6*b* of the second link member 6, the rotation of the retaining portion 108 in the yaw direction can be made to follow the ankle motions of the user properly.

Figure 4:
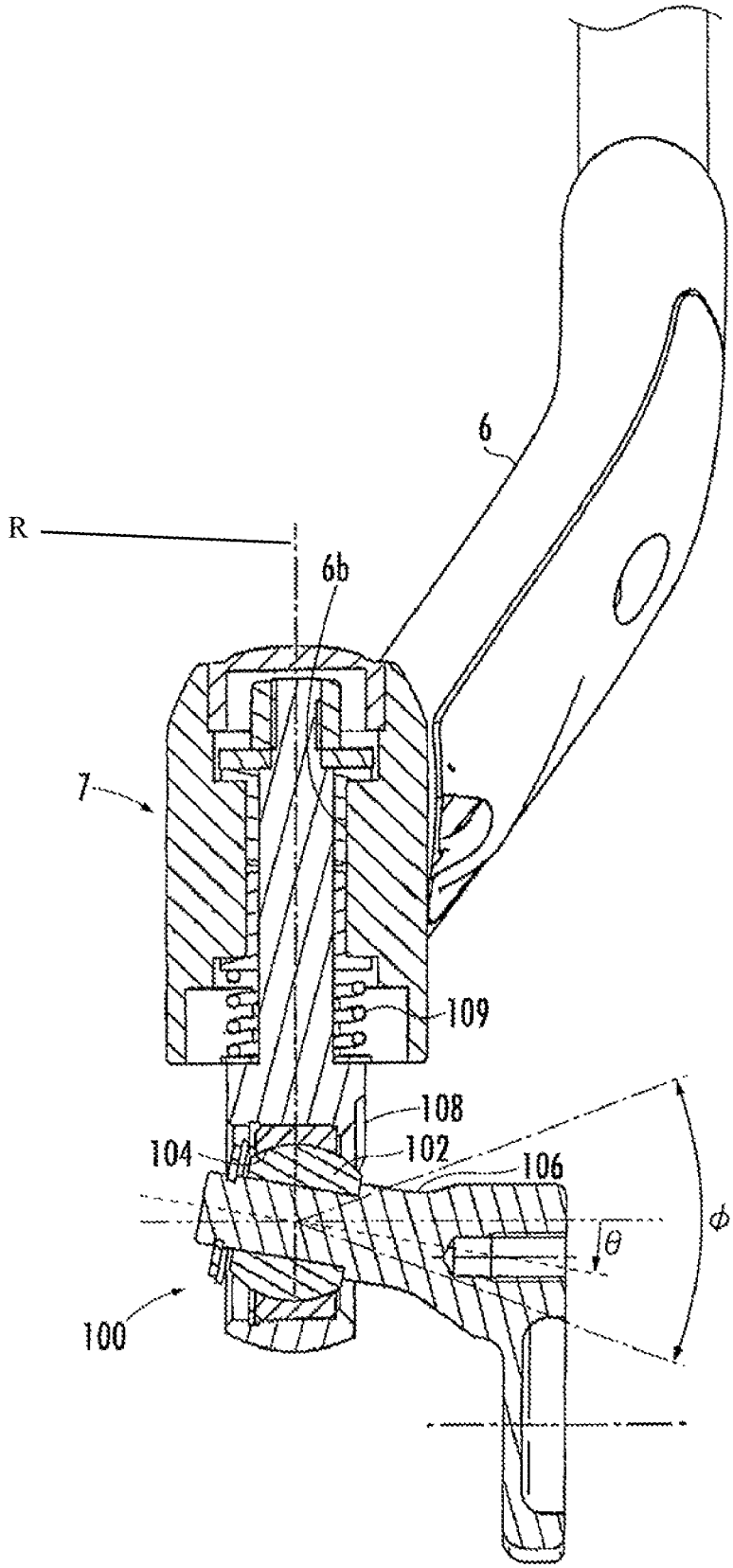
FIG. 4 is a sectional view illustrating another embodiment of an ankle joint in accordance with the present invention.

Furthermore, as illustrated in FIG. 4, it is acceptable to dispose a spring 109, which generates a biasing force in the vertical direction, between an opening portion of the through hole 6*b* which is provided at the lower end of the second link member 6 and the retaining portion 108.

Thereby, even though an impact is applied to the ground contact member 8 or the like, the impact can be alleviated by the spring 109, which prevents the leg link 2 from being subjected to the impact excessively. Although it is easy for the user to open his/her legs in the configuration of the ankle joint 7 mentioned above, an impact greater than the conventional one may be applied to the ankle joint 7 when the user opens his/her legs wider. However, the impact can be alleviated by the spring 109, which makes it more comfortable for the user to seat thereon. FIG. 4 illustrates the corresponding part in FIG. 3.

What is claimed is:

1. A walking assistance device comprising:

a seating member on which a user sits in a straddling manner;

a pair of leg links supporting the seating member from below; and a ground contact member connected to each of the leg links through an ankle joint, wherein the ankle joint is so configured that the ground contact member is freely swingable in a predetermined ground contact member swingable range relative to the leg link from a centered base position to an abduction side and an adduction side around a rolling axis with respect to the leg link, the rolling axis extending in an anteroposterior direction of the walking assistance device, the ground contact member swingable range from the centered base position to the adduction side is greater than that from the centered base position to the abduction side, and the centered base position of the ground contact member is a position at which the walking assistance device is in an upright state;

said ankle joint has a coupling mechanism which includes a joint shaft member connected at a first end to one of the leg link and the ground contact member, and a retaining portion which swingably retains a second end of the joint shaft member around the rolling axis in a predetermined coupling mechanism range and which is provided in one of the ground contact member and the leg link; and the ankle joint is configured to connect the ground contact member to the leg link such that, when the walking assistance device is in the upright state and the ground contact member is in the centered base position, the joint shaft member is inclined to the abduction side around the rolling axis from a middle position of the predetermined coupling mechanism.

2. The walking assistance device according to claim 1, wherein the coupling mechanism is a spherical joint having a sphere provided at the second end of the joint shaft member, and the retaining portion swingably retains the sphere around the rolling axis in the predetermined coupling mechanism range.

3. The walking assistance device according to claim 2, wherein:

the retaining portion is rotatably provided in the leg link so as to be rotatable in a yaw direction;

the joint shaft member extends in a lateral direction from the retaining portion; and one of the first end and the second end of the joint shaft member is connected to the ground contact member.

4. A walking assistance device comprising:

a seating member on which a user sits in a straddling manner;

a pair of leg links supporting the seating member from below; and a ground contact member connected to each of the leg links through an ankle joint, wherein the ankle joint is so configured that the ground contact member is freely swingable in a predetermined ground contact member swingable range relative to the leg link from a centered base position to an abduction side and an adduction side around a rolling axis with respect to the leg link, the rolling axis extending in an anteroposterior direction of the walking assistance device, the ground contact member swingable range from the centered base position to the adduction side is greater than that from the centered base position to the abduction side, and the centered base position of the ground contact member is a position at which the walking assistance device is in an upright state;

said ankle joint has a coupling mechanism which includes a joint shaft member and a retaining portion, the joint shaft member connected at a first end to the ground contact member and at a second end to the leg link, and the retaining portion provided in the leg link and swingably retaining the second end of the joint shaft member around the rolling axis in a predetermined coupling mechanism range; and the ankle joint is configured to connect the ground contact member to the leg link such that, when the walking assistance device is in an upright state and the ground contact member is in the centered base position, the joint shaft member is inclined to the abduction side around the rolling axis from a middle position of the predetermined coupling mechanism range.

5. The walking assistance device according to claim 4, wherein the coupling mechanism is a spherical joint having a sphere provided at the second end of the joint shaft member, and the retaining portion swingably retains the sphere around the rolling axis in the predetermined coupling mechanism range.

6. The walking assistance device according to claim 5, wherein:

the retaining portion is rotatably provided in the leg link so as to be rotatable in a yaw direction; and the joint shaft member extends in a lateral direction from the retaining portion

7. The walking assistance device according to claim 1, wherein the centered base position of the ground contact member is a position at which the ground contact member is centered relative to the leg link and is not swung to the abduction side or the adduction side.

8. The walking assistance device according to claim 1, wherein the predetermined coupling mechanism range is offset from the ground contact member swinging range.

9. The walking assistance device according to claim 8, wherein the ground contact member and the joint shaft member are configured to swing integrally with one another, and swinging of the joint shaft member across the predetermined coupling mechanism range corresponds to swinging the ground contact member across the ground contact member swingable range.

* * * * *